US006123125A

United States Patent [19]

Liao

[11] Patent Number: 6,123,125

[45] Date of Patent: Sep. 26, 2000

[54] WOOD PLANING MACHINE WITH A HEIGHT RETENTION MECHANISM FOR A CUTTER CARRIAGE

[76] Inventor: Juei-Seng Liao, No.295, Sec. 1, Nanking E. Rd., Tun Dist., Taichung City, Taiwan

[21] Appl. No.: 09/368,794

[22] Filed: Aug. 5, 1999

[51] Int. Cl.[7] ..... B27C 1/00

[52] U.S. Cl. ..... 144/130; 33/628; 144/117.1

[58] Field of Search ..... 33/626, 628, 630; 144/114.1, 116, 117.1, 129, 130

[56] References Cited

U.S. PATENT DOCUMENTS

| | | | |
|---|---|---|---|
| 2,630,150 | 3/1953 | Lacelle | 144/130 |
| 5,829,498 | 11/1998 | Liao | 144/130 |
| 5,904,192 | 5/1999 | Chen | 144/130 |

*Primary Examiner*—W. Donald Bray

*Attorney, Agent, or Firm*—Christie, Parker & Hale, LLP

[57] ABSTRACT

A planing machine is provided with a height retention mechanism for a cutter carriage, and includes a machine base, a plurality of upstanding posts, moving means, and a sector plate. The posts extend upward from the machine base. The cutter carriage is disposed above the machine base, and has opposite end portions mounted movably on the upstanding posts for sliding movement of the cutter carriage along the upstanding posts. The sector plate is mounted rotatably on the machine base about a horizontal axis, and has a stepped top face formed with a plurality of steps, which are at different elevations relative to the machine base. A regulating rod extends downward from the cutter carriage above the stepped top face. The sector plate is rotatable about the horizontal axis to align the regulating rod with a selected one of the steps and to enable the regulating rod to contact the selected one of the steps and stop further movement of the cutter carriage toward the machine base, thereby retaining the cutter carriage at a desired height relative to the machine base.

10 Claims, 6 Drawing Sheets

WOOD PLANING MACHINE WITH A HEIGHT RETENTION MECHANISM FOR A CUTTER CARRIAGE

BACKGROUND OF THE INVENTION

1. Field of the Invention

The invention relates to a wood planing machine, more particularly to a wood planing machine with a height retention mechanism for a cutter carriage.

2. Description of the Related Art

Referring to FIGS. 1 and 2, a conventional wood planing machine 10 is shown to include a machine base 11, left and right pairs of upstanding posts 12 (only one post 12 is shown in FIG. 2), a cutter carriage 13, and a height adjustment mechanism 20.

As illustrated, the machine base 11 has opposite mounting sides 111 spaced apart from each other in a transverse direction, and opposite feed-in and take-out sides spaced apart from each other in a longitudinal direction. The upstanding posts 12 extend upward from the machine base 11 at the mounting sides 111. The cutter carriage 13 is disposed above the machine base 11, and has opposite end portions 130 mounted movably on the upstanding posts 12 for sliding movement of the cutter carriage 13 along the upstanding posts 12. A cutter device 14 is mounted on the cutter carriage 13, and is rotatable about a horizontal axis that extends in the transverse direction.

The height adjustment mechanism 20 includes a transmission rod 23 disposed within the machine base 11 along the transverse direction, a pair of screw rods 21, 22 mounted rotatably on and extending upwardly from the machine base 11 at the mounting sides 111 to pass threadedly through the cutter carriage 13 at the opposite end portions 130 thereof. The screw rods 21,22 have lower ends 211, 221 coupled with the transmission rod 23 via pairs of bevel gears 222,232 which are also disposed in the machine base 11. A turning handle 24 is provided at the top end of one of the screw rods 21 such that rotation of the latter will cause the cutter carriage 13 to slide along the upstanding posts 12 so as to define a gap between the cutter carriage 13 and the machine base 11 for passage of a work piece (not shown) to be processed.

It is noted that height retention in the conventional wood planing machine 10 is achieved solely through the threaded engagement between the cutter carriage 13 and the screw rods 21, 22. In addition, non-synchronous rotation of the screw rods 21, 22 due to indirect rotation of the transmission rod 23 upon operation of the turning handle 24 may result in uneven height adjustment of the cutter carriage 13 relative to the machine base 11, thereby adversely affecting the quality of the planing operation.

SUMMARY OF THE INVENTION

Therefore, the object of this invention is to provide a wood planing machine which is clear of the aforementioned drawbacks that result from the use of the conventional wood planing machine.

Accordingly, the wood planing machine of the present invention includes a machine base, a plurality of upstanding posts, a cutter carriage, moving means, and height retention means. The machine base has opposite mounting sides spaced apart from each other in a transverse direction, and feed-in and take-out sides disposed apart from each other in a longitudinal direction. The upstanding posts extend upward from the machine base at the mounting sides. The cutter carriage is disposed above the machine base, and has opposite end portions mounted movably on the upstanding posts for sliding movement of the cutter carriage along the upstanding posts. The moving means moves the cutter carriage along the upstanding posts for adjusting a height of the cutter carriage relative to the machine base. The height retention means retains the cutter carriage at a desired height relative to the machine base, and includes a sector plate mounted rotatably on the machine base about a horizontal axis. The sector plate has a stepped top face formed with a plurality of steps, which are at different elevations relative to the machine base. A regulating rod extends downward from the cutter carriage above the stepped top face. The sector plate is rotatable about the horizontal axis to align the regulating rod with a selected one of the steps and to enable the regulating rod to contact the selected one of the steps and stop further movement of the cutter carriage toward the machine base, thereby retaining the cutter carriage at the desired height relative to the machine base.

Preferably, the sector plate further has a curved bottom face opposite to the stepped top face and formed with a plurality of retention grooves that correspond respectively to the steps. The height retention means further includes a spring-loaded tumbler mounted on the machine base such that the tumbler confronts the curved bottom face of the sector plate and engages releasably one of the retention grooves corresponding to the selected one of the steps that is aligned with the regulating rod.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
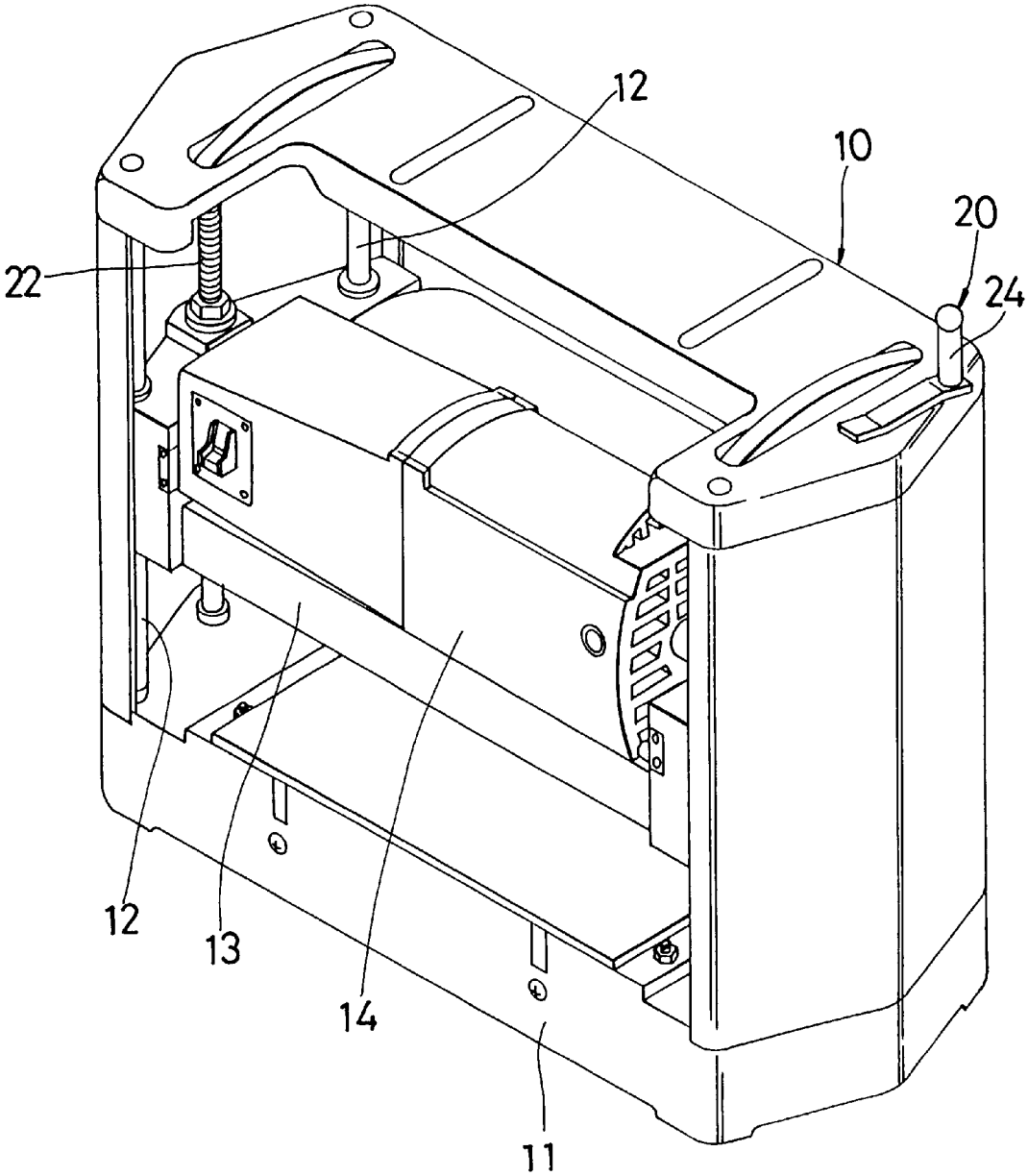
FIG. 1 PRIOR ART
FIG. 1 is a perspective view of a conventional wood planing machine with a height retention mechanism for a cutter carriage.
Figure 2:
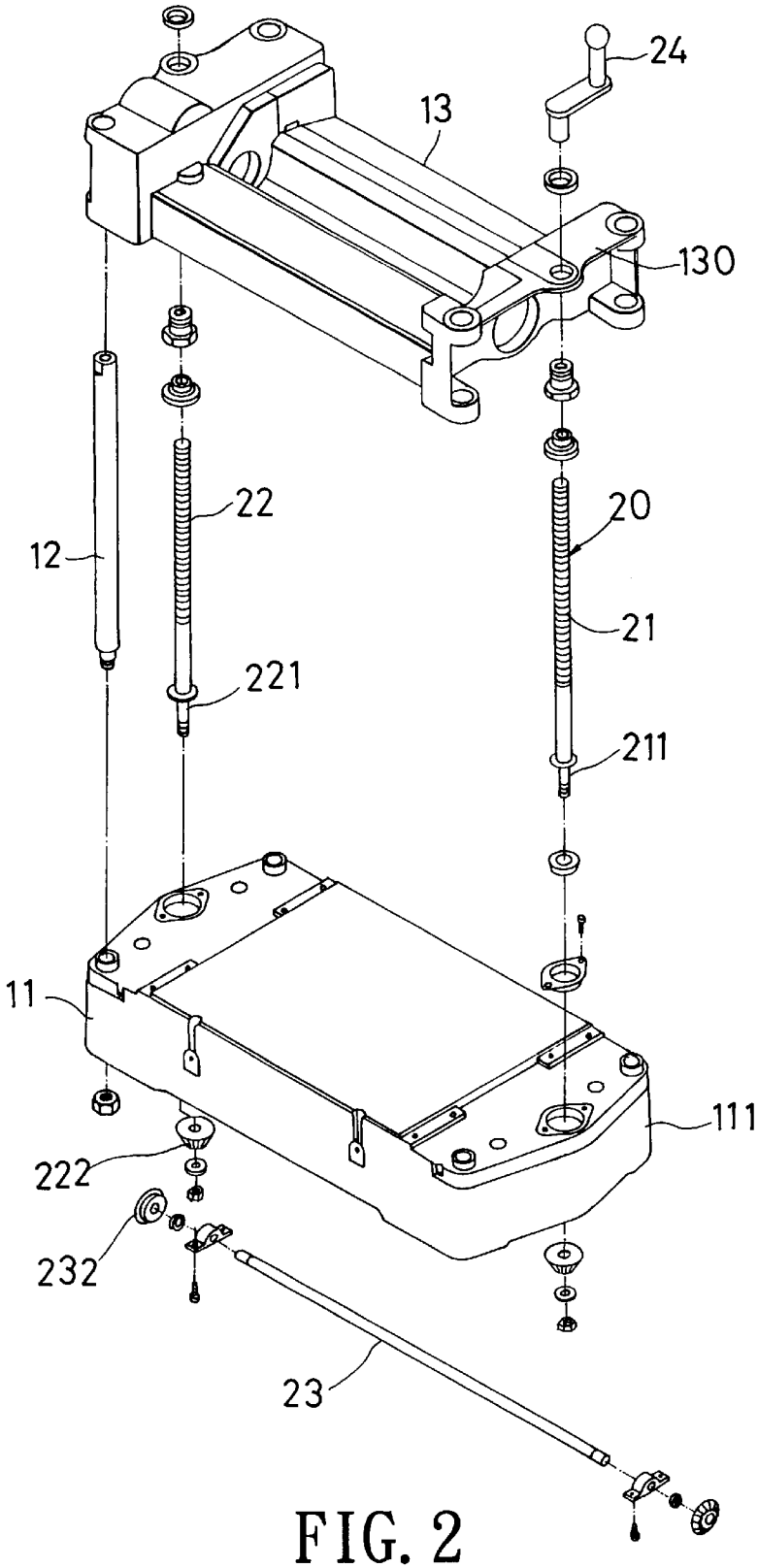
FIG. 2 PRIOR ART
FIG. 2 is an exploded view of the conventional wood planing machine, illustrating how the height retention mechanism is mounted therein.
Figure 3:
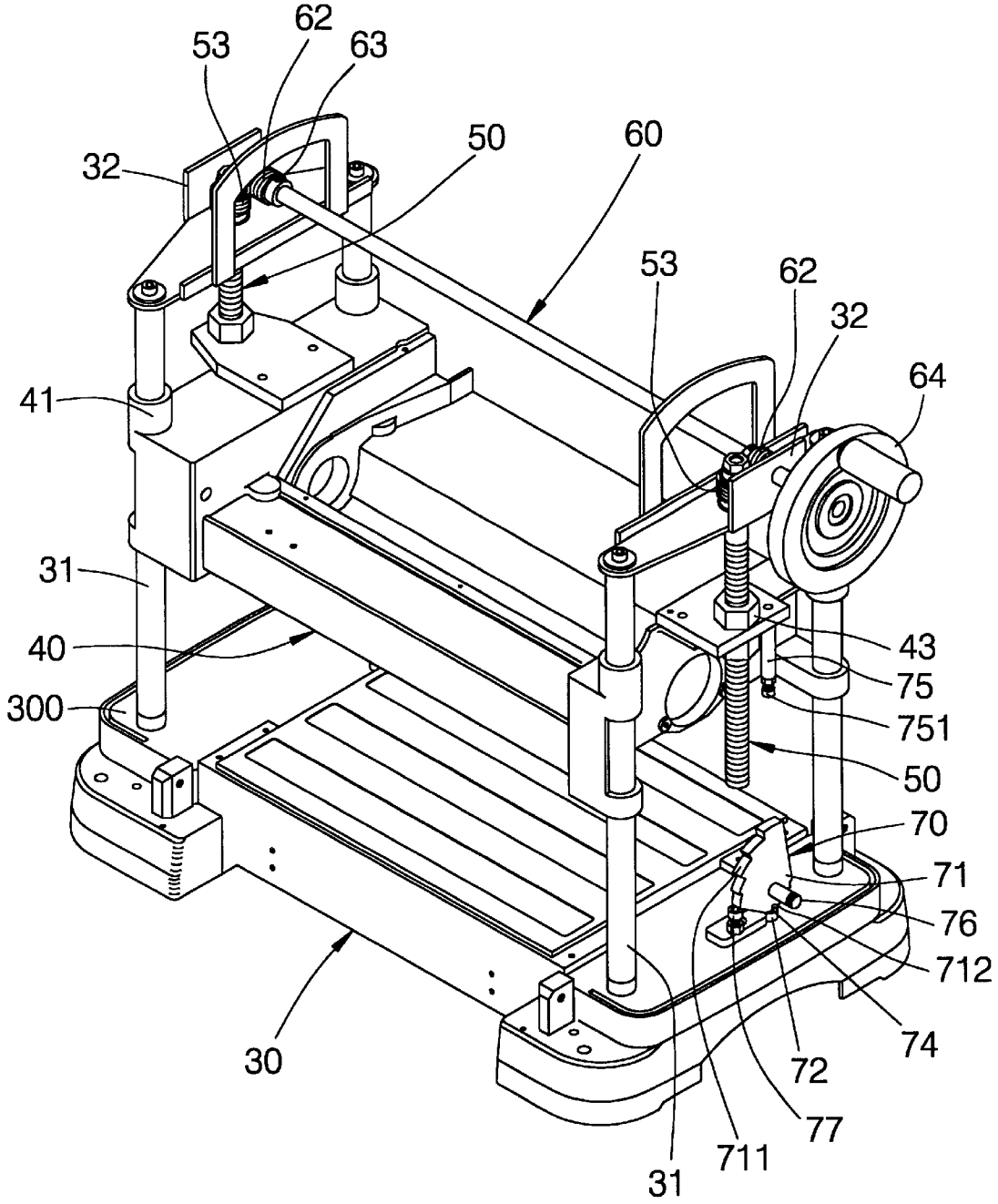
FIG. 3 is a perspective view of the preferred embodiment of a wood planing machine of this invention.
Figure 4:
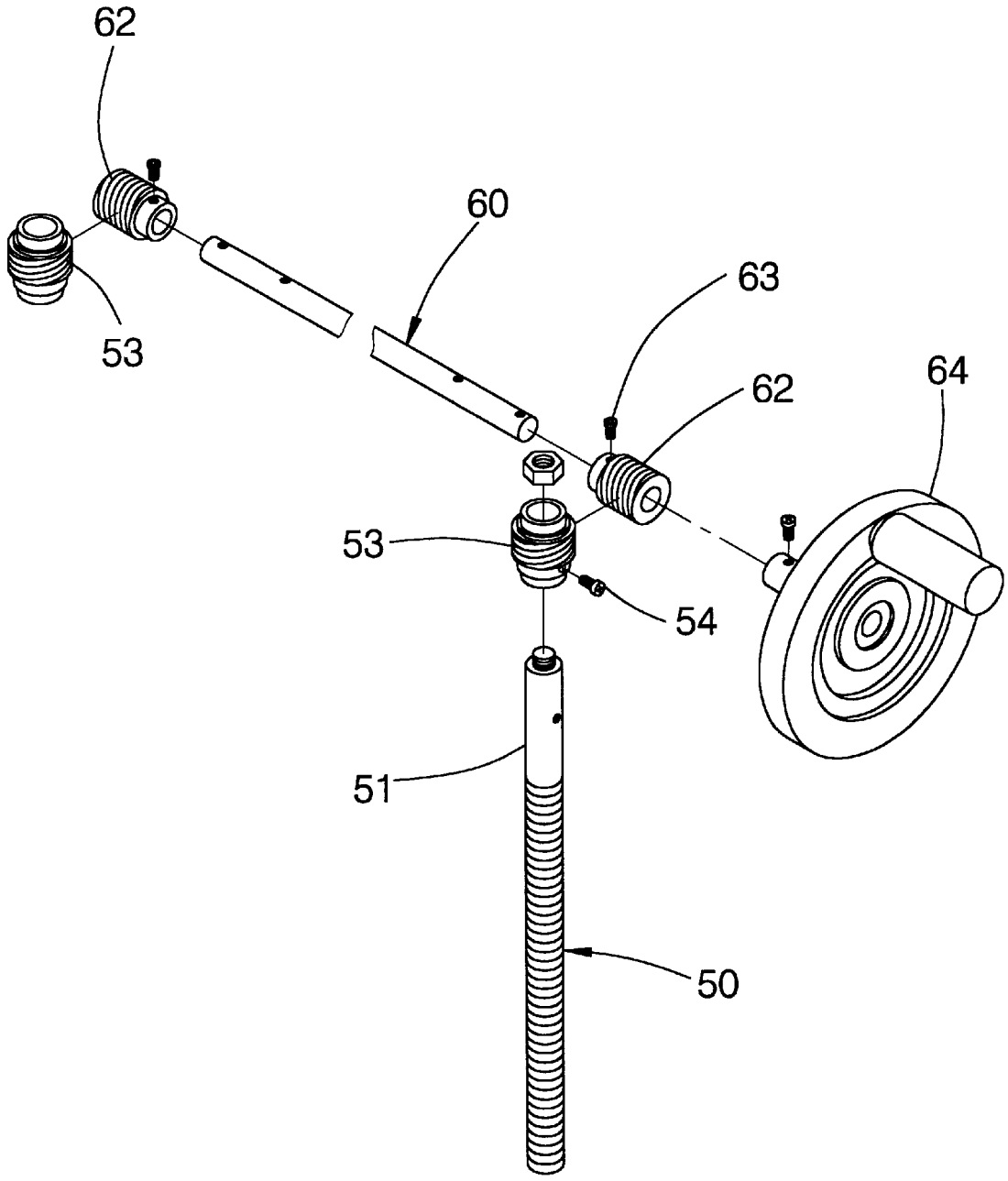
FIG. 4 is an exploded view of a moving device incorporated in the preferred embodiment.
Figure 5:
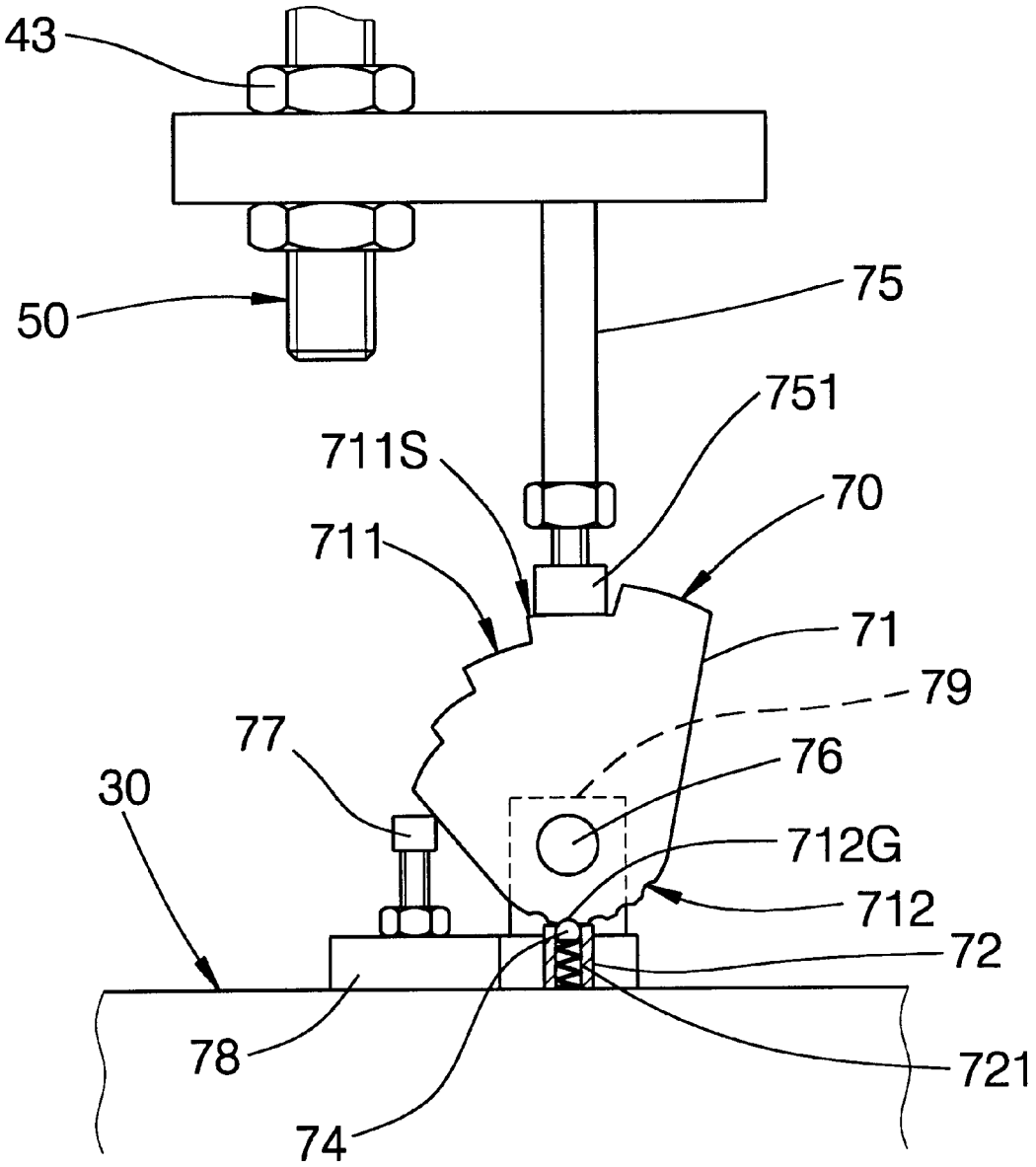
FIG. 5 is a fragmentary schematic side view illustrating how a cutter carriage is retained at a desired height in the preferred embodiment.

Referring to FIGS. 3,4, and 5, the preferred embodiment of a wood planing machine of this invention incorporates a height retention mechanism 70 that includes a sector plate 71, and a regulating rod 75.

As illustrated, the wood planing machine includes a machine base 30 that has opposite mounting sides 300 spaced apart from each other in a transverse direction, and feed-in and take-out sides disposed apart from each other in a longitudinal direction. Left and right pairs of upstanding posts 31 extend upward from the machine base 30 at the mounting sides 300. A cutter carriage 40 is disposed above the machine base 30, and has opposite end portions 41 mounted movably on the upstanding posts 31 for sliding movement of the cutter carriage 40 along the upstanding posts 31. As is known in the art, the cutter carriage 40 is adapted for mounting a cutter device (not shown) and a drive unit (not shown) for the cutter device thereon.

The sector plate 71 is mounted rotatably on the machine base 30 about a horizontal axis that is parallel to the transverse direction. The sector plate 71 has a step top face 711 formedwith a plurality of steps (711S). The steps (711S) have different elevations, such as ⅛, ¼, ½, ¾, 1 inch, relative to the machine base 30.

The regulating rod 75 extends downward from the cutter carriage 40 above the stepped top face 711. The sector plate 71 is rotatable about the horizontal axis to align the regulating rod 75 with a selected one of the steps (711S) and to enable the regulating rod 75 to contact the selected one of the steps (711S) and stop further movement of the cutter carriage 40 toward the machine base 30, thereby retaining the cutter carriage 40 at a desired height relative to the machine base 30.

The sector plate 71 further has a curved bottom face 712 opposite to the stepped top face 711 and formed with a plurality of retention grooves 712G that correspond respectively to the steps (711S). A spring-loaded tumbler 74 is mounted on the machine base 30 such that the tumbler 74 confronts the curved bottom face 712 of the sector plate 71 and engages releasably one of the retention grooves (712G) corresponding to the selected one of the steps (711S) that is aligned with the regulating rod 75. The steps (711S) and the retention grooves (712G) are arranged along the longitudinal direction. The sector plate 71 is preferably provided with an operating handle 76 on an outer surface thereof to facilitate manual control of the movement thereof.

In the preferred embodiment, a support plate 78 is disposed on the machine base 30. A mounting flange 79 projects upwardly from the support plate 78 to permit assembly of the sector plate 71 thereon such that the sector plate 71 is rotatable about the horizontal axis. Preferably, the support plate 78 has a recess 72 to receive a spring retention ring 721, which, in turn, accommodates the spring-loaded tumbler 74 therein. A support post 77 is mounted adjustably on the support plate 78 adjacent to the sector plate 71. The support post 77 is adjustable in the longitudinal direction to abut against one side of the sector plate 71 so as to arrest undesired rotation of the sector plate 71 about the horizontal axis.

A pair of screw rods 50 (only one screw rod 50 is shown in FIG. 4) to pass threadedly through opposite end portions 41 of the cutter carriage 40, respectively. A rotary rod 61 is disposed above the cutter carriage 40, and extends in the transverse direction between the screw rods 50. A worm drive mechanism connects the rotary rod 60, the screw rods 21, 22 and the cutter carriage 40 to move the cutter carriage 40 along the upstanding posts 31 when the rotary rod 60 is rotated. The screw rods 50, the rotary rod 60 and the worm drive mechanism thus constitute moving means for moving the cutter carriage 40 and adjusting the height of the carriage 40 relative to the machine base 30. The worm drive mechanism includes two worm gears 53 mounted respectively on top ends 51 of the screw rods 50 by means of locking screws 54, and two worms 62 mounted on opposite ends of the rotary rod 60 by the use of fastener screws 63 and meshing with the worm gears 53, respectively. The worm drive mechanism further includes two internally threaded mounting units 42 (see FIG. 3) mounted securely and respectively on the opposite end portions 41 of the cutter carriage 40 for engaging threadedly and respectively the screw rods 50.

A pair of mounting brackets 32 (see FIG. 3) are mounted on distal top ends of the upstanding posts 31 and are spaced apart from each other in the transverse direction. The rotary rod 60 extends between and is journalled rotatably on the mounting brackets 32. A control wheel 64 is mounted on one end of the rotary rod 60.

Preferably, the regulating rod 75 has a distal end provided with an adjustment bolt 751 threadedly mounted thereon for contacting the selected one of the steps (711S) (see FIG. 5).

Figure 6:
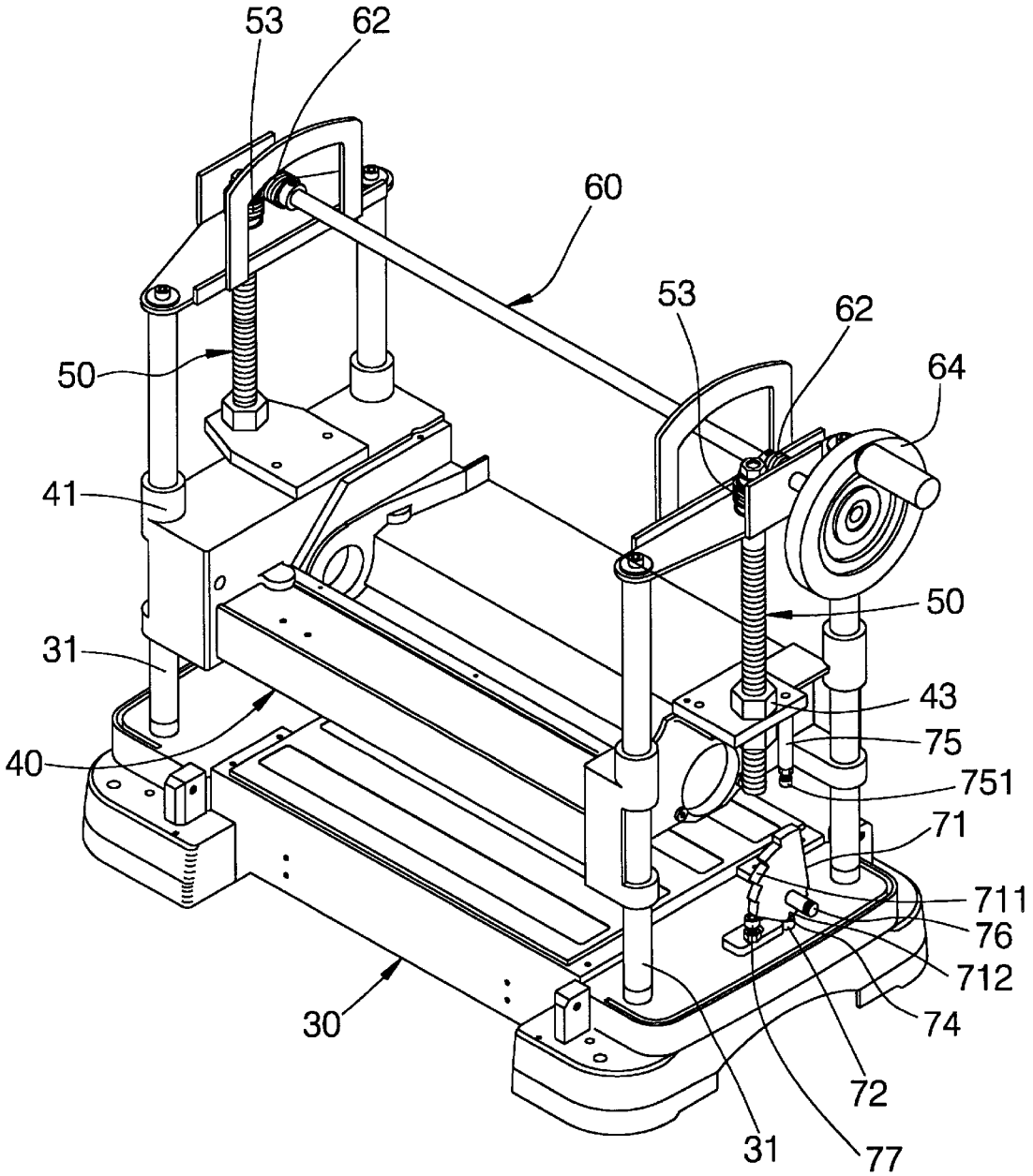
FIG. 6 is another perspective view similar to FIG. 3, illustrating the preferred embodiment after adjustment.

As illustrated in FIG. 6, when adjusting the height of the cutter carriage 40 relative to the machine base 30, the cutter carriage 40 is firstly moved upward by turning the control wheel 64. The sector plate 71 is then rotated about the horizontal axis with the use of the operating handle 76 so as to align a selected step (711S) with the regulating rod 75. The support post 77 is adjustable in the longitudinal direction to abut against the sector plate 71 so as to arrest undesired rotation of the sector plate 71 about the horizontal axis. Under this condition, the cutter carriage 40 can be moved downward by rotation of the control wheel 64, wherein the regulating rod 75 contacts the selected step (711S), thereby defining the desired height of the cutter carriage 40 relative to the machine base 30.

Because the control wheel 64 is mounted directly on the rotary rod 60, the screw rods 21, 22 can rotate synchronously when the control wheel 64 is turned, thereby moving the cutter carriage 40 smoothly along the upstanding posts 31 relative to the machine base 30. This eliminates the possibility of an uneven height of the cutter carriage 40 relative to the machine base 30.

Further, since most of the components of the wood planing machine are mounted above the machine base 30, repair and maintenance of the wood planing machine of this invention is facilitated.

Since the mounting of the cutter device on the cutter carriage 40 is not pertinent to the present invention, a detailed description thereof is omitted herein for the sake of brevity.

With this invention thus explained, it is apparent that numerous modifications and variations can be made without departing from the scope and spirit of this invention. It is therefore intended that this invention be limited only as indicated in the appended claims.

I claim:

1. A wood planing machine comprising:

a machine base having opposite mounting sides spaced apart from each other in a transverse direction, and feed-in and take-out sides disposed apart from each other in a longitudinal direction;

a plurality of upstanding posts extending upward from said machine base at said mounting sides;

a cutter carriage disposed above said machine base and having opposite end portions mounted movably on said upstanding posts for sliding movement of said cutter carriage along said upstanding posts;

moving means for moving said cutter carriage along said upstanding posts and for adjusting a height of said cutter carriage relative to said machine base; and height retention means for retaining said cutter carriage at a desired height relative to said machine base, said height retention means including a sector plate mounted rotatably on said machine base about a horizontal axis, said sector plate having a stepped top face formed with a plurality of steps, said steps having different elevations relative to said machine base, and a regulating rod extending downward from said cutter carriage above said stepped top face, said sector plate being rotatable about the horizontal axis to align said regulating rod wish a selected one of said steps and to enable said regulating rod to contact the selected one of said steps and stop further movement of said cutter carriage toward said machine base, thereby retaining said cutter carriage at the desired height relative to said machine base.

2. The wood planing machine as defined in claim 1, wherein said sector plate further has a curved bottom face opposite to said stepped top face and formed with a plurality of retention grooves that correspond respectively to said steps, said height retention means further including a spring-loaded tumbler mounted on said machine base such that said tumbler confronts said curved bottom face of said sector plate and engages releasably one of said retention grooves corresponding to the selected one of said steps that is aligned with said retention rod.

3. The wood planing machine as defined in claim 2, wherein the horizontal axis extends in the transverse direction, and said steps and said retention grooves are arranged along the longitudinal direction.

4. The wood planing machine as defined in claim 3, wherein said height retention means further includes a support post mounted adjustably on said machine base adjacent to said sector plate, said support post being adjustable in the longitudinal direction to abut against one side of said sector plate so as to arrest undesired rotation of said sector plate about the horizontal axis.

5. The wood planing machine as defined in claim 1, wherein said moving means comprises:

a pair of screw rods passing through said opposite end portions of said cutter carriage, respectively;

a rotary rod extending in the transverse direction between said screw rods; and a worm drive mechanism connected to said rotary rod, said screw rods and said cutter carriage to move said cutter carriage along said upstanding posts when said rotary rod is rotated.

6. The wood planing machine as defined in claim 5, wherein said worm drive mechanism includes:

two worm gears mounted respectively on said screw rods; and two worms mounted on said rotary rod and meshing with said worm gears, respectively.

7. The wood planing machine as defined in claim 6, wherein said worm drive mechanism further includes two internally threaded mounting blocks mounted securely and respectively on said opposite end portions of said cutter carriage for engaging threadedly and respectively said screw rods.

8. The wood planing machine as defined in claim 7, further comprising a pair of mounting brackets mounted on distal top ends of said upstanding posts and spaced apart from each other in the transverse direction, said rotary rod extending between and being journalled rotatably on said mounting brackets.

9. The wood planing machine as defined in claim 7, wherein said worm drive mechanism further includes a control wheel mounted on one end of said rotary rod.

10. The wood planing machine as defined in claim 1, wherein said retention rod has a distal end with an adjustment bolt mounted threadedly thereon for contacting the selected one of said steps.

* * * * *